US008317354B2

(12) United States Patent
Gassner et al.

(10) Patent No.: US 8,317,354 B2
(45) Date of Patent: Nov. 27, 2012

(54) LAMP, ESPECIALLY SUSPENDED LAMP, COMPRISING A FIRST AND A SECOND LIGHT EMITTING AREA

(75) Inventors: Patrick Gassner, St. Gerold (AT); Manfred Petschulat, Wolfurt (AT); Hartmut S. Engel, Ludwigsburg (DE)

(73) Assignee: Zumtobel Lighting GmbH (AT)

( * ) Notice: Subject to any disclaimer, the term of this patent is extended or adjusted under 35 U.S.C. 154(b) by 658 days.

(21) Appl. No.: 12/297,278

(22) PCT Filed: Apr. 18, 2007

(86) PCT No.: PCT/EP2007/003410
§ 371 (c)(1),
(2), (4) Date: Nov. 2, 2009

(87) PCT Pub. No.: WO2007/121910
PCT Pub. Date: Nov. 1, 2007

(65) Prior Publication Data

US 2010/0067236 A1 Mar. 18, 2010

(30) Foreign Application Priority Data

Apr. 18, 2006 (DE) ..... 10 2006 018 255
Apr. 18, 2006 (EP) ..... 06008000

(51) Int. Cl.
*F21S 8/06* (2006.01)

(52) U.S. Cl. ..... 362/147; 362/217.05; 362/218; 362/241; 362/282

(58) Field of Classification Search ..... 362/147, 362/218, 217.02, 217.05, 217.03, 408, 277–284, 362/148, 235–237, 241–248
See application file for complete search history.

(56) References Cited

U.S. PATENT DOCUMENTS

| | | | | |
|---|---|---|---|---|
| 4,007,365 | A * | 2/1977 | Stempfle et al. | 362/283 |
| 5,733,036 | A * | 3/1998 | Montgomery | 362/283 |
| 6,076,943 | A * | 6/2000 | Lassovsky | 362/283 |
| 6,102,554 | A * | 8/2000 | Wynne Willson et al. | 362/281 |
| 7,832,907 | B2 * | 11/2010 | Kotovsky et al. | 362/321 |

FOREIGN PATENT DOCUMENTS

| | | |
|---|---|---|
| DE | 19859936 | 7/2000 |
| DE | 10161468 | 7/2003 |
| EP | 1275898 | 1/2003 |
| EP | 1734300 | 6/2005 |
| EP | 1584864 | 10/2005 |

OTHER PUBLICATIONS

Machine Translation of EP 1584864.*
International Search Report PCT/EP2007/003410; Dated Dec. 5, 2007.

* cited by examiner

*Primary Examiner* — Jong-Suk (James) Lee
*Assistant Examiner* — Leah S Macchiarolo
(74) *Attorney, Agent, or Firm* — Cantor Colburn LLP

(57) ABSTRACT

The invention relates to a lamp (1), especially a suspended lamp, comprising a housing (2) that is provided with a first light emitting area (4) with a first light influencing element (9) on one side thereof while being fitted with a second light emitting area (21) with a second light influencing element (22) on another side for direct illumination. In order to improve indirect illumination of the lamp, the second light influencing element (22) can be moved into at least two different positions (S1, S2, S3).

26 Claims, 6 Drawing Sheets

LAMP, ESPECIALLY SUSPENDED LAMP, COMPRISING A FIRST AND A SECOND LIGHT EMITTING AREA

TECHNICAL FIELD OF THE INVENTION

The invention relates to a luminaire, and particularly to a luminaire having first and second light emitting areas to improve indirect illumination provided thereby.

BRIEF DISCUSSION OF RELATED ART

In the case of a luminaire of this type it is a matter of known designs, previously known in particular as suspended luminaires. An important feature of this luminaire is that it has a first light-emitting area for direct illumination of the space on one side of its housing and a second light-emitting area that is used to illuminate the space indirectly and is arranged on the rear side of the luminaire opposite the first light-emitting area. The purpose of the second light-emitting area that has a light-permeable light-influencing element is to lighten the surroundings of the luminaire at the side and/or rear in order to reduce the difference in light intensity between the first light-emitting area and the surroundings of the luminaire and/or to bring about, in addition to direct illumination, indirect illumination in particular on the rear side of the luminaire, this improving the illumination of the space and reducing differences in brightness in the rear and lateral areas of the luminaire. Such a luminaire is described, for example, in EP 1 734 300 A1.

The light-permeable light-influencing element of the second light-emitting area can, for example, be an element that is light-permeable or partly light-permeable and is formed by a light-permeable disc or a perforated sheet, that is arranged, for example, in the area of the rear wall of the housing of the luminaire.

Luminaires of the kind previously described are as a rule suspended at a distance of at least 50 cm from the ceiling. Such pendant heights guarantee, on the ceiling side, a non-dazzling luminous density that is perceived as being pleasant. In certain cases of application, however, the luminaires need to be assembled either at a short distance from the ceiling or in the case of high spaces also at an unusually large distance from the ceiling, something which can result, on the one hand, in undesirably high luminous densities occurring on the ceiling side that could count against such a mounting and accordingly restrict the operational possibilities of the luminaire, or can result, on the other hand, in the case of a great pendant height in luminous densities occurring on the ceiling side that are too low and the proportion of indirect light that is desired in the space becoming too small.

BRIEF SUMMARY OF THE INVENTION

The invention improves a luminaire of the kind specified at the beginning with respect to indirect illumination. In particular, the light that is emitted for indirect illumination is to be utilized in a better way, preferably for the lateral edge areas of the luminaire. In this connection, the luminaire is to be capable of being mounted whilst guaranteeing optimum light distribution both with regard to direct light and with regard to indirect light, both with low pendant heights and immediately underneath the ceiling, that is, in a so-called built-on or surface-mounted position, with large pendant heights, in the case of corresponding room heights.

The recognition underlying the invention is that indirect illumination is significant in particular in the lateral edge area of the luminaire, since a lack of indirect illumination substantially results in differences in brightness, in particular in the edge area of the luminaire.

In the case of the luminaire in accordance with the invention a second light-influencing element that is associated with the second emitting area can be adjusted into at least two different positions. As a result, it is possible to adapt the second light-influencing element to specific influences or even to no influence of the light of indirect illumination. It is possible to provide as a second light-influencing element, for example on the ceiling side on the luminaire or a corresponding carrier profile, a swivel-mounted and/or detachably mounted light-distributing wing, whose form and/or size and also whose position and/or inclination in relation to the vertical central plane of the luminaire can be selected in particular as a function of the respective distance of the luminaire from the ceiling. The second light-influencing element can thus be adjusted, for example, in such a way that it can be used to define the opening for the light of indirect illumination in order, according to the position, to define a smaller or larger opening, or to free the opening completely.

In particular, when the second light-influencing element is a reflector, the indirect light can be reflected and deflected to the side for intensified illumination of the side-edge area of the luminaire. In this case, in addition to the reflective surfaces that are already present, if applicable, on the luminaire side, additional reflective surfaces and, if applicable, also anti-glare surfaces are provided that lead to specific possibilities of adaptation to different room heights or pendant heights.

In the case of low spaces and correspondingly short pendant heights that can go as far as direct built-on situations, the light-distributing wings are configured and dimensioned, for example, in such a way that inadmissibly high luminous densities at the ceiling are avoided and a brightening of a large area of the ceiling and thus direct-light production are effected. In the case of very large pendant heights, on the other hand, in which the luminous density at the ceiling becomes too low and there can be inadequate production of indirect light, the light-distributing wings are preferably configured with a larger surface and are used to emit into the space the desired, soft indirect light which in this case cannot be delivered to a sufficient extent by way of reflection at the ceiling.

Since the light-distributing wing that is used as a second light-influencing element can be formed so that it is reflective, transparent and/or partly transparent, it is possible, in consideration of the largely freely selectable wing forms and wing sizes, to achieve very different light distribution between direct and indirect light, depending on the respective sphere of use of the luminaires.

An advantageous further development of the invention can lie not only in the fact that the second light-influencing element is formed so that it can be swivelled, in particular so that it can be swung into a parked position, but also in the fact that in an analogous way a light-permeable cover located above a fluorescent lamp arranged in the luminaire housing can be configured so that it can be swung or swivelled up in a corresponding manner and the lamp is thus easily accessible if possibly it needs to be changed.

The second light-influencing element is preferably swivel-mounted on a covering profile which can be coupled to a reinforcing profile or hollow carrier profile, which is open on the ceiling side, in particular by way of a snap-latching connection. The use of the covering profile for mounting the second light-influencing element results, on the one hand, in a solution that is extremely simple technically and basically can also be retrofitted and, on the other hand, permits a transfer, which can be effected by means of a simple process of swivelling, of the second light-influencing element out of a parked position above the covering profile that is ineffective in terms of lighting technology into a functional position in which as a result of reflective and/or diffusing effects it distributes light coming from the light source located in the luminaire, or from corresponding reflective surfaces, over a large surface over the ceiling. In the case of this embodiment, the second light-influencing element is preferably configured with a comparatively small surface, that is, its surface substantially corresponds to a reflective surface adjacent to it on the carrier-profile side, without being restricted to this size ratio of the reflective surfaces.

For the case of great pendant heights in correspondingly high rooms or spaces, on the other hand, the second light-influencing element preferably has a large-surface concave outer area which as a complement to the associated reflective surface of the reinforcing profile or hollow carrier profile not only contributes to the production of direct light, but is also used to provide the desired proportion of indirect light which in this case on account of the great pendant height cannot be provided by diffusing effects at the ceiling.

An advantageous further development is further distinguished by the fact that the covering profile has on the edge side in each case a partly cylindrical, upwardly open groove with a cylindrical profile bar which is concentric with respect to the groove and is connected to the groove base by way of a web, that the bearing-side edge of the second light-influencing element is formed as a partly cylindrical coupling element, and that in the joined state the partly cylindrical groove with profile bar concentric to the groove and the coupling element that engages in the receiving area between the groove and profile bar in a form-locking manner form a swivel hinge. The opening of the partly cylindrical groove is then matched to the partly cylindrical coupling element of the second light-influencing element in such a way that the second light-influencing element perpendicularly to the longitudinal extent of the receiving groove can be inserted into this groove and then as a result of the second light-influencing element swinging out of the position of insertion the actual hinge formation is effected automatically. Decoupling between the second light-influencing element and the covering profile is in turn possible in a correspondingly simple manner, since for this the light-influencing element merely needs to be swivelled back into the position of insertion outlined above and then can be detached from the covering profile.

This ease of coupling and detachment of the second light-influencing element is also advantageous in connection with a further special feature of the invention, namely the possibility of being able to plug the light-influencing element into the receiving groove of the covering profile so that it is offset by 180°, because with this type of assembly the light-influencing element can be folded down outwards and is then supported, for example, on the upper, light-permeable cover for the light source. The consequence of this is that a selectable portion of this light-permeable lamp cover has glare-suppression upwards and the light striking this portion of the cover is reflected downwards by means of the second light-influencing element in order to intensify the direct light. It can thus be ensured that the luminous density at the ceiling directly above the lamps always remains in the permissible range.

A further advantage of the invention that also needs special mention lies in the fact that the second light-influencing element, which preferably consists of a heat-conducting material and is coupled in a heat-conducting manner to the hollow carrier profile, forms effective cooling surfaces in all of its operating positions.

The development in accordance with the invention is suitable for all such luminaires whose side edge is at a distance directed transversely with respect to the emitting side of the luminaire from its carrier, in particular the ceiling of a room. The invention is therefore extremely well suited for a suspended luminaire. The invention is also suitable, however, for a built-on luminaire, in particular when the rear wall of the luminaire is inclined towards the side edge.

In the case of this development in accordance with the invention the housing is a flat housing, with the second emitting areas being arranged on the rear side of the flat housing, and the quick-acting connections being arranged in the area of the inner edges of the second emitting areas. This development in accordance with the invention results in a luminaire of flat construction, in which indirect illumination is difficult on account of the low structural height. The developments in accordance with the invention, however, even given such a luminaire construction, render possible the improvement that is striven for in indirect illumination, in particular in the opposing side edge areas of the luminaire. Moreover, in the case of this luminaire the second light-influencing elements can be assembled and dissembled with ease of handling and the luminaire can thus be adapted selectively to indirect illumination.

In accordance with the third independent a luminaire, in particular an indoor luminaire or suspended luminaire with a flat construction, is proposed that has light-exit surfaces which are situated on the room- and/or ceiling-side, a hollow carrier profile which is arranged centrally and between two end portions and has a high level of transverse bending strength, with internal receiving space and external concave reflective surfaces for at least two fluorescent lamps extending adjacently to the hollow carrier profile and parallel thereto, and also light-guiding chambers which are provided on both sides of the hollow carrier profile and at the side of the fluorescent lamps, extend so that they taper up to the lateral boundary of the luminaire, and are closed by light-exit surfaces at least on the room side, wherein provided on the ceiling side there are light-influencing elements in the form of light-distributing wings which are swivel-mounted and/or detachably mounted on the hollow carrier profile and whose form and/or size and also whose position and/or inclination in relation to the vertical central plane of the hollow carrier profile can be selected in particular as a function of the respective distance of the luminaire from the ceiling.

The invention further renders possible simple, small constructions that can be produced inexpensively and are suitable in particular for an elongated luminaire.

BRIEF DESCRIPTION OF THE DRAWINGS

Advantageous developments of the invention are explained in greater detail in the following with the aid of preferred exemplary embodiments and drawings, in which.

DETAILED DESCRIPTION OF THE INVENTION

Figure 1:
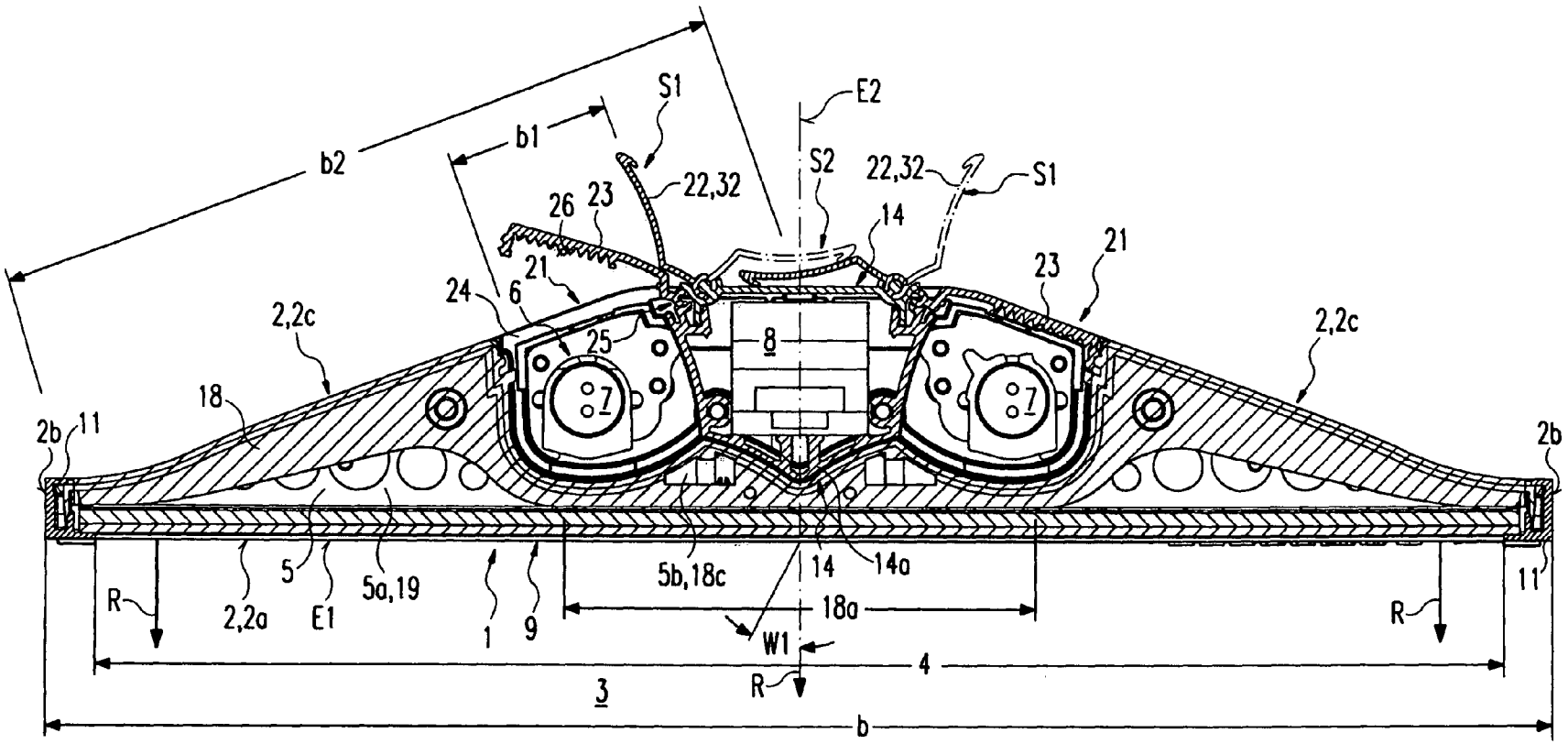
FIG. 1 shows a luminaire in accordance with the invention in vertical cross section.

The main portions of the luminaire, denoted in its entirety by 1, are constituted by a housing 2, which on its emitting side, namely on its side facing the space 3 that is to be illuminated, has a first light-emitting area 4 which in the present exemplary embodiment of the luminaire 1 substantially extends over the whole side of the housing 2 facing the space 3 and thereby preferably extends in an emitting plane E1.

The housing 2 encloses, with its emitting-side, light-permeable base wall 2*a*, opposing side walls 2*b* and a rear wall 2*c* opposite the first emitting area 4, a housing interior space 5 in which at least one connection means 6 is arranged and secured, for example to a housing inner wall, for at least one lamp 7 that is connected to an electric power supply by means of electric lines that are not shown. The lamp 7 can, for example, be a so-called fluorescent lamp, pertaining to the power supply of which there is an operating device 8 which can be arranged, for example, likewise between the base wall 2*a* and the rear wall 2*c* in the interior space 5.

Arranged in the emitting area 4 that preferably extends substantially over the whole emitting side of the housing 2 there is a first light-influencing element 9 that constitutes the base wall 2*a*, is preferably formed so that it is planar and in particular has glare suppression so that the maximum size of a lateral emitting angle W1 that deviates from the main emitting direction R extending at right angles to the emitting plane E1 is limited to an angular measure that results in sufficient suppression of glare with regard to a person standing in the illuminated space 3 and looking obliquely upwards. This can be achieved by means of a glare-suppressing structure known per se that is arranged on the first light-influencing element 9 on the outside or inside or is arranged between two discs lying one on top of the other and forming the first light-influencing element 9. In this case, the glare-suppressing structure can be formed on the associated side of the relevant light-influencing element or the disc respectively or on a transparent foil which can be arranged on the inside or outside or between the afore-mentioned disc-shaped elements.

Figure 4:
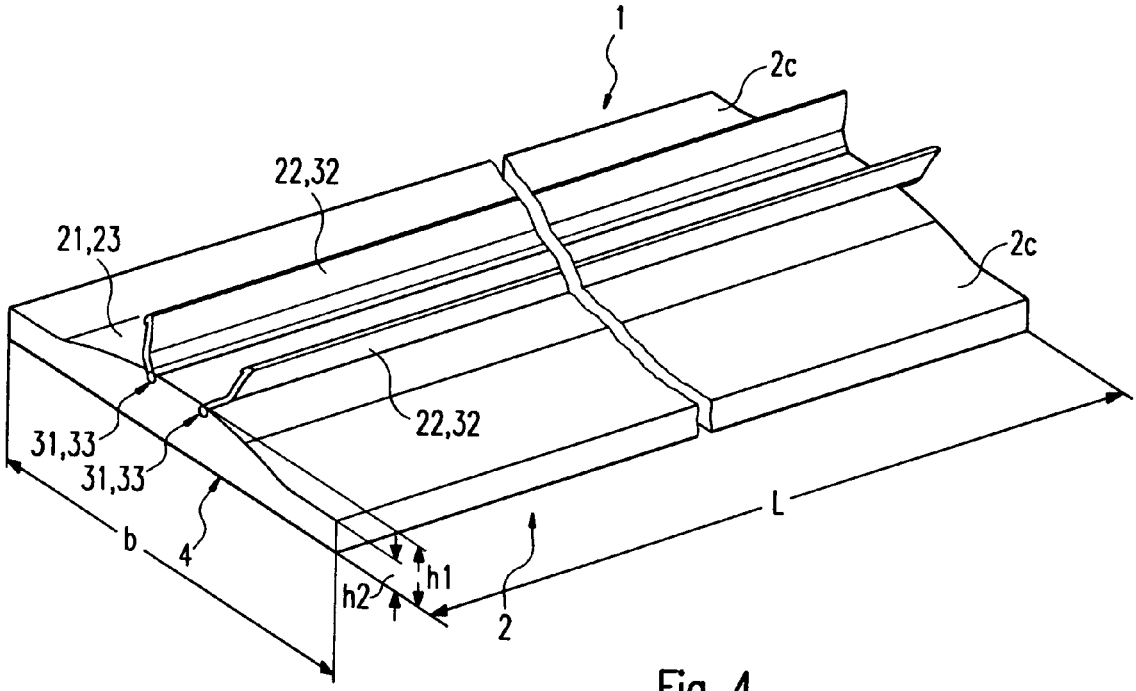
FIG. 4 shows the luminaire in a perspective side view from above.

The luminaire 1 has a four-cornered shape in the viewing direction at right angles to the first emitting area, in which case it is formed preferably in an elongated manner transversely with respect to the plane of the drawing sheet, as shown in FIG. 4. This can be a single luminaire or a luminaire 1 which at its longitudinal ends is formed so that a plurality of luminaires 1 can be lined up to form a row of lights.

The luminaire 1 is preferably a so-called flat luminaire, that is, it is designed with a flat construction of the housing 2, with the width b, which extends transversely in relation to the longitudinal direction, being in a ratio to the height h1 that amounts to approximately 4:1 to 8:1, in particular to approximately 3:1.

In particular in the case of a luminaire 1 of elongated construction it is possible to provide on both sides of its vertical central plane or longitudinal central plane E2 connection means 6 for two lamps 7, for example in the one end area or in both end areas two respective holders for two lamps 7, preferably in the form of tubes, in particular fluorescent tubes, extending in a straight line.

In the case of the exemplary embodiment, the rear wall 2*c* is formed in an outwardly inclined manner on both sides of the vertical central plane E2 so that the height h1 of the housing 2 tapers towards the lateral or longitudinal sides, preferably to the height h2 of a side profile 11 that connects together the edges of the base wall 2*a* and the rear wall 2*c* and forms a low side wall 2*b*.

In the first instance, a reinforcing profile 14 in the form of a hollow carrier profile is described that is arranged between the two lamps 7 in the middle or centrally in relation to the vertical longitudinal central plane E2 and has a substantially V- or U-shaped cross-sectional form and is integrated in the housing 2 in such a position that its base web 14*a* is at a vertical distance from the preferably planar or plate-shaped first light-influencing element 9, and its lateral profile legs 14*b* extend into the upper area of the housing 2, for example have a vertical spacing from the upper side of the housing 2. The walls of the reinforcing profile 14—when considered from the outside—are formed in a concave manner, as a result of which the reinforcing profile 14 becomes a multifunctional profile, since it not only has a supporting function and with regard to its interior space a receiving function for ballasts and the like, but its outer surfaces are simultaneously used as reflective surfaces. Light-guiding chambers are correspondingly formed on both sides of the reinforcing profile that extend so that they taper towards the side boundary of the luminaire.

The reinforcing profile 14 is closable or is closed on the upper side by means of a profile cover 15 which is connected to the free edge areas of the profile legs 14*b* in a detachable manner preferably by means of a quick-acting connection constructed as a snap-latching connection, for example by being clipped on. A respective latching connection 16 is provided for this between the edge areas of the profile legs 14*b* and the associated edges of the preferably flat profile cover 15. This can be formed by latching legs 14*c* that rise up from the profile legs 14*b* and cooperate in a latching manner with latching legs 15*a* projecting downwards from the profile cover 15. The operating device 8 is preferably arranged in the hollow space 17 of the reinforcing profile 14.

The reinforcing profile 14 preferably extends over the length of the luminaire 1, which extends transversely with respect to the drawing plane, and can be connected, for example, to face walls on the end side of the housing 2 or be supported thereon. In order to stabilize the housing 2, bearing webs 18 are provided that are arranged at longitudinal distances from each other and are connected at their upper edges to the rear wall 2*c* and stabilize it. The bearing webs 18 can extend over the whole width of the interior space, in which case in the central area they reach down as far as the first light-influencing element 9 and can support it on the rear side or inside. On both sides of this supporting area 18*a*, in the bearing webs 18 there are recesses 19 which in each case under the relevant lateral areas of the bearing webs 18 provide a respective lateral, longitudinally through-going interior space area 5*a*. In the supporting area 18*a* of the bearing webs 18 it is possible for there to be, for example underneath the reinforcing profile 14, one or more, for example two eccentric, recesses 18*c* that likewise form longitudinally through-going interior-space areas 5*b* which can be used, for example, as a cable duct.

On the rear side opposite the first emitting area 4 the luminaire 1 has at least one second light-emitting area 21 for indirect illumination that is formed by a light-permeable or partly light-permeable section in the rear wall 2*c* and coordinated with which, preferably on the outside, there is a second light-influencing element 22—described further in greater detail in the following—with which the light emitted from the second emitting area 21 can be influenced or changed, in particular deflected laterally.

The suspension of the luminaire 1 shown is preferably effected by way of suspension means which cooperate with cables and can be connected to the end portions of the luminaire 1. Usually, the pendant height of the luminaire 1 from the ceiling amounts to at least 50 cm so that the indirect light directed towards the ceiling does not produce a disturbingly high and possibly dazzling luminous density on the ceiling. This does not, however, apply to the case of a lower pendant height amounting, for example, to merely approximately 25 cm and of course also not when the luminaire has to be assembled directly in a so-called built-on position underneath the ceiling.

In order to ensure in these cases where there is a short distance between the luminaire 1 and the ceiling that the desired proportion of indirect light is obtained, the luminaire 1 in accordance with the invention is provided with the light-influencing elements 22 that distribute the indirect light widely even when the distance of the luminaire 1 to the ceiling is short and ensure that the luminous density at the ceiling remains in the prescribed area.

In the case of the present exemplary embodiment, in which on both sides of the vertical central plane E2 two connection elements 6 are arranged for or with a lamp 7, two second emitting areas 21 in each case with a second light-influencing element 22 are arranged in a mirror-inverted manner with regard to the vertical central axis E2. In the following, the description is therefore restricted to one half of the luminaire, namely the left-hand half of the luminaire.

The second emitting area 21 is located in the rear emitting area above the lamp 7 or above the connection means 6, in the area of which the associated lamp 7 is positioned. Indirect illumination is promoted by virtue of the fact that the second emitting area 21 is arranged so that it is inclined towards the associated side edge. The angle W2 between the rear wall 2*c* and the base wall 2*a* amounts to approximately 20 to 40°, in particular to approximately 30°.

In the case of the present exemplary embodiment, the second emitting area 21 is formed by a light-permeable or partly light-permeable covering wall 23 which closes an opening 24, corresponding to its shape, in the rear wall 2*c*, in particular by virtue of the fact that the covering wall 23 can be positioned in the opening 24, in which case it forms a section of the rear wall 2*c*. The opening 24 is large enough for the lamp 7 to be moved through it and can be connected to the connection element or elements 6 or can be taken away or exchanged. The at least one connection element 6 is formed in such a way that the lamp 7 with its contact elements during its movement of insertion and removal can be brought into contact with associated counter-contact elements of the housing 2 during insertion, and contact therewith can be broken during withdrawal. If, for example, the lamp 7 has contact pins protruding on the end side, on the housing side the contact slots that receive the contact pins are arranged and directed in the direction of movement in such a way that the contact pins can be plugged into the slots during insertion of the lamp 7 and can be extracted during removal.

The covering wall 23 is connected to the housing 2 by means of a joint 25 which connects the covering wall 23 in the area of its one edge, in particular in the area of its edge facing the vertical central plane E2, to the associated edge area of the housing 2. As a result, the covering wall 23 is not only swivel-mounted between its closed position and an open position that renders possible assembly or disassembly of the lamp 7, but is also held in a non-detachable manner on the housing 2.

For additional light-influence, the covering wall 23 can have, for example, on its inside light-directing elements 26 to influence the light shining through.

The second emitting area 21 is preferably arranged adjacently to the reinforcing profile. The width b1 of the second emitting area 21 amounts to approximately one third to one fifth, in particular approximately one quarter, of the dimension b2 of the associated rear-wall half. It is, however, to be noted here that it would also be possible to extend the second emitting area towards the side of the luminaire. Thus, for example, not only is it possible to configure the covering wall 23 so that it is transparent or light-permeable, but it is also possible to provide for the rear wall of the luminaire housing adjoining the covering wall 23 to be configured so that it is at least partly light-permeable.

The joint 25 can preferably be assembled by latching its joint portions and disassembled by unlatching, that is, by means of a respective movement of assembly or disassembly directed transversely with respect to the joint axis.

The covering wall 23 can be formed, for example, in a U-shaped manner with two edge-located legs 23*a*, 23*b* directed inwards, with the associated joint portion being arranged in the free edge area of the inner wall leg 23*a*. As a result, the joint 25 can be realized in a position where it is sunk into the housing 2. The wall leg 23*b* on the outer edge stabilizes and improves the covering wall 23 in the closed position, for example by means of a lug 27 which in the sunken closed position in accordance with FIGS. 2 and 3 on the right cooperates with the opposing edge of the opening 24 in a latching or clamping manner.

The joint portions can be formed by means of an undercut groove with two claw-shaped groove legs 25*c*, between which a joint pin 25*b*, which is cylindrical in cross section for example, can be latched and unlatched by elastically bending out the groove legs.

Within the scope of the invention, the joint 25 can be formed by means of a plug/rotary holder without latching, with a holder groove that is open towards the free edge of the covering wall 23 and renders possible swivelling of the covering wall 23 in the plugged-in position without the plug portion of the covering wall 23 on the covering-wall side being latchable therein. The securement of the covering wall 23 in such a holder groove is automatically effected in the closed position of the covering wall 23 by virtue of the fact that the covering wall 23 is delimited by the edge of the opening 24 in the holder groove lying opposite the holder groove.

The second light-influencing element 22 is formed by a light-distributing wing in the form of a thin wall portion which is detachably connected to the housing 2 by means of a quick-acting connection 31 in the area of the rear wall 2*c*. In the case of the exemplary embodiment, the quick-acting connection 31 is located in the area of the joint 25 or the plug holder, partly sunk for example into the outer surface of the rear wall 2*c* and/or offset inwards by the measure of offset v.

The second light-influencing element 22 can be adjusted, strictly speaking swung, into at least two different positions, with the quick-acting connection 31 that is located on the hollow carrier profile or the reinforcing profile 14 permitting this. Two possible positions for the second light-influencing element 22 are denoted by S1 and S2. In position S1, the so-called light-distributing position, the second light-influencing element 22 protrudes transversely with respect to the rear wall 2*c*, namely upwards in the case of a ceiling luminaire. In position S2 (FIG. 3), the folded-down position, on the other hand, the second light-influencing element 22 is located in a position moved towards the rear wall 2*c*, in which case it preferably rests against the covering wall 23 and completely or partly or, as the case may be, almost covers the covering wall 23 or the opening 24 respectively. In the case of the exemplary embodiment, the width b3 of the light-influencing element 22 is so great that its free edge ends at a distance c before the outer edge of the second light-emitting area 21 or the opening 24. The distance c amounts, for example, to approximately ¼ of b1.

The wall surface 22*a* that is directed towards the associated side in position S1 is preferably curved, preferably curved or rounded in the form of a cylinder section, about an axis of curvature extending parallel to the central plane E2.

It is the purpose of the second light-influencing element 22 to influence the light emitted from the second emitting area 21, in particular the light emitted in the area of the second emitting area 21 that faces the central plane E2, and as a result to change the indirect illumination. To this end, the second light-influencing element 22 can be at least partly light-permeable or form a reflector 32 which reflects the light, emitted by the second emitting area 21 to it, towards the side remote from the central plane E2. The reflector 32 can be formed, for example, in that the wall surface 22*a* facing the second emitting area 21 is a reflective surface. In the position shown, the second light-influencing element 22 encloses with the central plane E2 an acute angle W2 that can amount to less than approximately 40°. In this swung-out light-distributing position S1 accordingly light coming from the fluorescent lamps and passing through the light-permeable cover 23 is deflected at the concavely formed wall surface used as a reflective and/or diffusing surface and is distributed widely over the ceiling so that when the luminaire is assembled close to the ceiling inadmissible high luminous densities at the ceiling are avoided and indirect light is produced uniformly.

In position S2 the second light-influencing element 22 is used to cover the opening 24 or the second light-emitting area 21 completely or partly or, as the case may be, almost completely and as a result shade the light at least in part. If the second light-influencing element 22 here is formed as a reflector 32, the light in the covered area is reflected so that in this area practically no light losses result. This second position S2 is used, for example, to avoid or reduce the indirect illumination. This arrangement of the second light-influencing element 22 is thus specifically chosen when the luminaire has to be assembled immediately underneath the ceiling, that is, in a so-called built-on position. In this folded-down situation, the light-influencing element 22 is located directly above or in such a way that it adjoins the light-permeable cover 23 so that the light is cut-off upwardly and the proportion of light striking the light-influencing element 22 is reflected downwards to intensify the direct light. The light-influencing element 22 that has been folded down outwardly thus ensures by means of the shielding effect achieved that on the ceiling the luminous density always stays in the permissible region.

Figure 2:
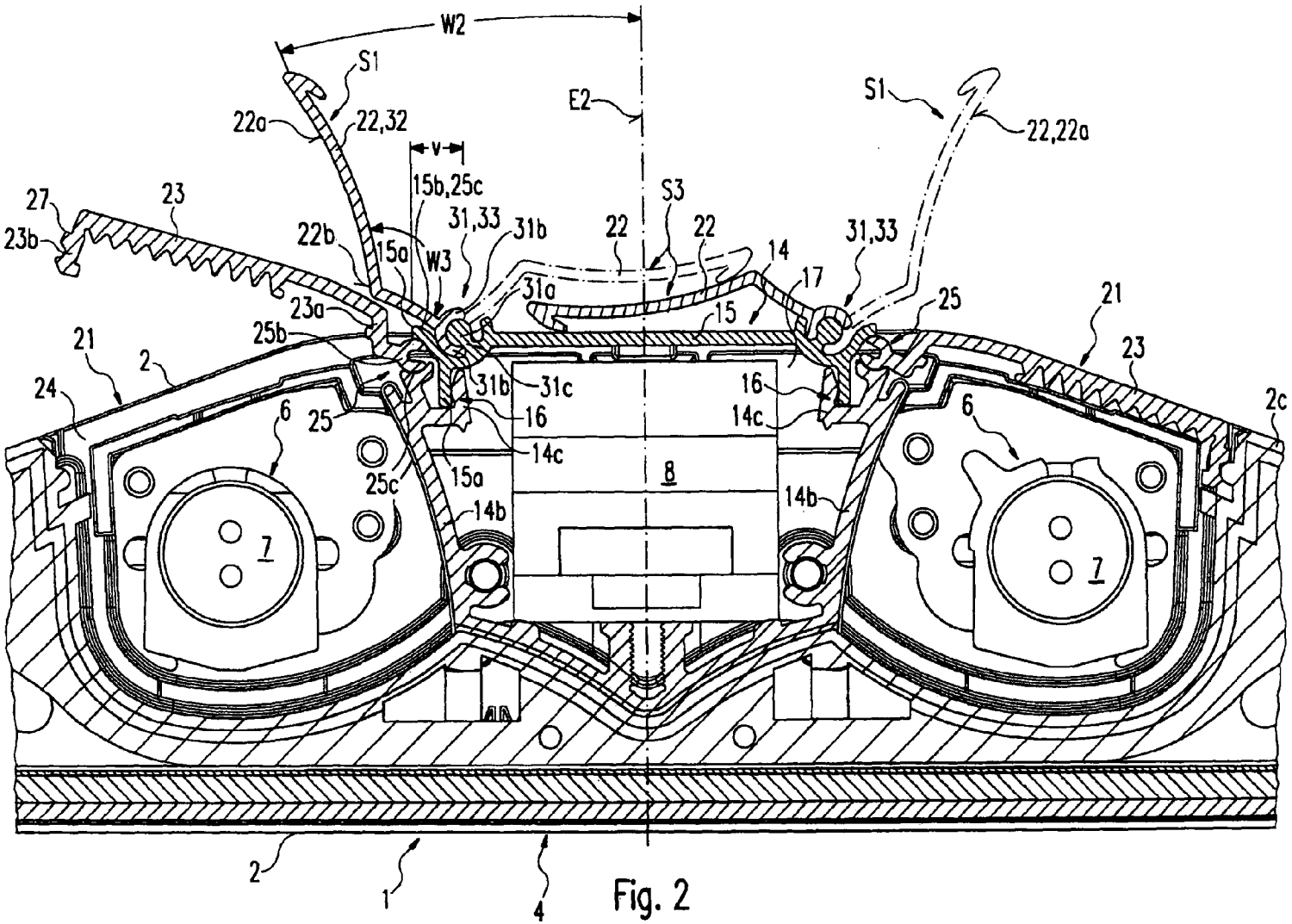
FIG. 2 shows the upper and central partial area of the luminaire in an enlarged representation.
Figure 3:
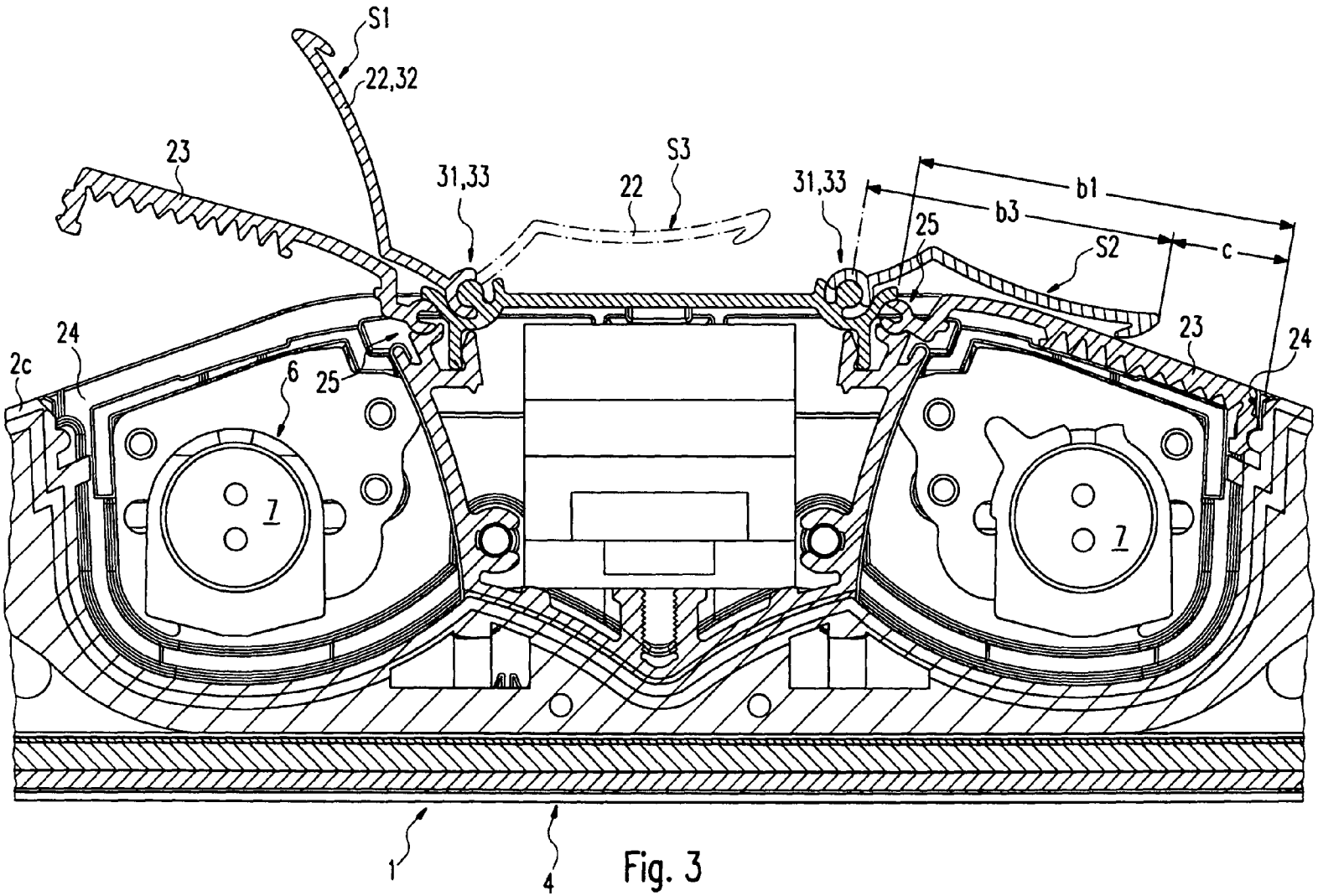
FIG. 3 shows the partial area in a special functional position.

The second light-influencing element 22 can preferably be adjusted, furthermore, into a third position S3 in which it is moved inwards and towards the housing 2, in which case it can be located on the upper side of the housing 2 and can rest on the rear wall 2*c* or on the profile cover 15. In this position S3 the second light-influencing element 22 is located in a position of non-use or in a parked position that is ineffective in terms of lighting technology and can, for example, also be a packing or transportation position. If both light-influencing elements 22 are provided, they can overlap and lie one on top of each other, as shown in FIGS. 1 and 2.

It is of significance in the case of this development and positioning of the light-influencing element 22 in accordance with the invention furthermore that the latter is practically not visible in particular in the parked position S3 and also in the folded-down position S2 resting against the light-permeable covering wall 23 and in these positions S2, S3 lies inside a line of sight below which a viewer in the space sees the luminaire 1 that has been suspended or fitted on the ceiling side. The appearance of the luminaire 1 is accordingly only changed negligibly by the light-influencing element 22.

Figure 5:
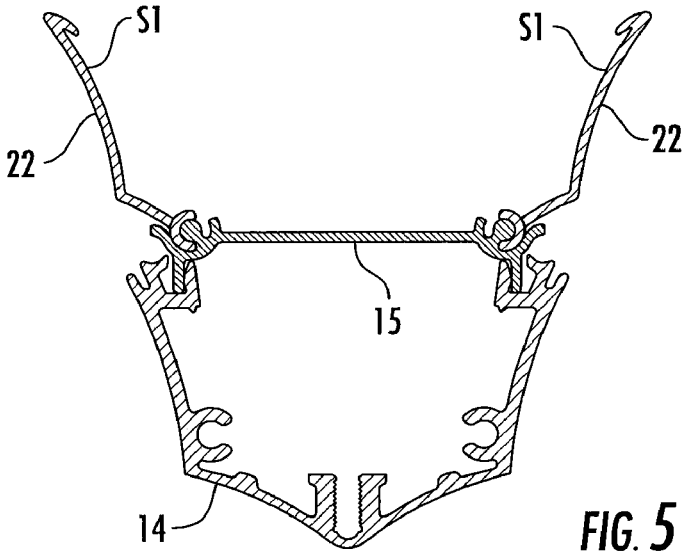
FIGS. 5 to 7 show the second light-influencing elements in three different positions.
Figure 6:
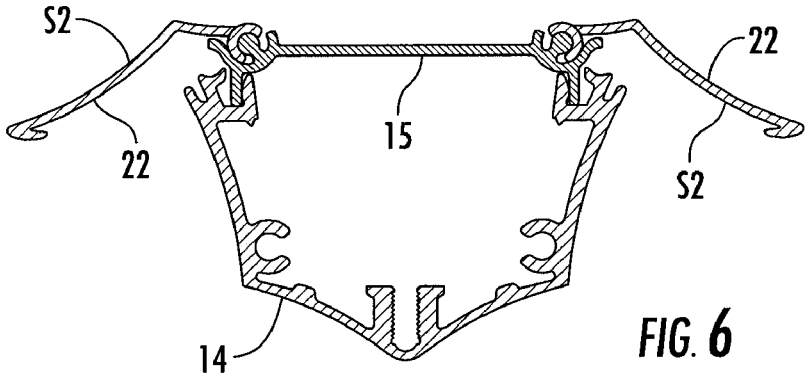
Figure 7:
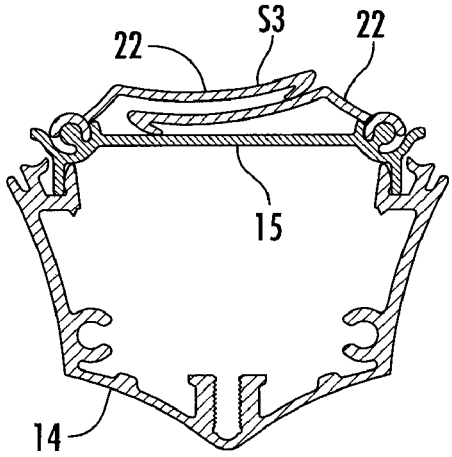

The three possible positions S1 to S3 previously described for the light-influencing elements 22 are shown again in FIGS. 5 to 7, in which case in these representations merely the arrangement of the light-influencing elements 22 with regard to the reinforcing profile 14 is shown.

In order to facilitate the assembly and/or the adjustment of the second light-influencing element 22 and to configure it for ease of handling, it is advantageous to form the quick-acting connection 31 as a swivel hinge or joint 33 in such a way that the second light-influencing element 22 can be swivelled between its positions S1 and S2. If the light-influencing element 22 can be additionally fixed in optional swivel positions, for example as a result of tightness in the quick-acting connection, swivel positions and light-influencing positions can be realized selectively.

Another possibility of adjusting the second light-influencing element 22 from position S2 into position S3 or vice versa lies in detaching the light-influencing element 22 and turning it by 180° substantially parallel to the rear wall or an imaginary plane extending on the rear wall and re-connecting it in the quick-acting connection 31.

For the purposes of simplification and facilitation of the assembly or disassembly it is therefore advantageous to realize the quick-acting connection 31 by means of a clamping or latching plug connection, for example a latching connection or a plug/swivel connection, as shown by the exemplary embodiments.

The latching connection is formed by means of a latching pin 31*a* preferably of rounded cross-section and two latching claws 31*b* that can be elastically latched onto it. In the case of the exemplary embodiment, the latching pin 31*a* is arranged by way of a web on the reinforcing profile 14, preferably on its cover 15, in an upwardly open, partly cylindrical groove, and the latching claws 31*b* are arranged on the associated edge of the light-influencing element 22. Latching is effected in that the latching claws 31*b* when plugged on spring out elastically and in the plugged-on state grip behind the latching pin 31*a* somewhat, springing in automatically. The latching pin 31*a* is fixedly connected by means of a small connecting web 31*c* to its carrier. The distance between the latching claws 31*b* in the peripheral direction is so great, considering the small width of the connecting web 31*c*, that the light-influencing element 22 can be swivelled between position S1 and position S3.

In order to adjust the light-influencing element 22 between its positions S1 and S3, the previously described rotation by 180° is required, in which case the light-influencing element 22 is to be detached, turned and re-latched.

The arrangement is preferably such that in the reflecting position S1 the light-influencing element 22 is impeded or restricted from swivelling towards the covering element 23, namely as a result of a stop position between the associated connecting claw 31*b* and the connecting web 31*c*.

In the case of the exemplary embodiment, the wall of the light-influencing element 22 consists of two wall sections enclosing an obtuse angle W3, the apex 22*b* of which is located substantially above the inner edge of the second light-emitting area 21. The inner area of the light-influencing element 22 is used in this case to receive the latching claws 31*b*, whilst, on the other hand, the outer area is used as a reflector or diffusing surface and can be anodized to make it matt, for example.

In the case of the exemplary embodiment, the latching connection or the integrated joint 33 is located in the edge or corner area of the cover 15.

The joint 25 for the covering wall 23 in the case of the exemplary embodiment is, to be, formed between the upper edge area of the associated profile leg 14*b* and a leg 15*b* that extends obliquely outwards and upwards from the cover 15 and which at the same time forms the associated groove leg 25*c*. As a result, the joint 25 is arranged between the associated profile leg 14*b* and the cover 15.

The second light-emitting area 21 and the covering element 23 and the second light-influencing element 22 preferably extend over the dimension or length L of the housing 2 extending transversely with respect to the drawing plane. This also applies in the case of an elongated formation of the luminaire 1 in accordance with FIG. 4.

The second light-influencing element 22 and the covering element 23 and also the associated joint portions, here the latching pin 31*a* and the latching claws 31*b* and also the groove legs 25*c*, extend transversely to the drawing-sheet plane preferably continuously and in a straight line. These portions can thus be produced inexpensively as profiled portions, for example by drawing or extruding a respective long semi-finished product and cutting it to length.

Figure 8:
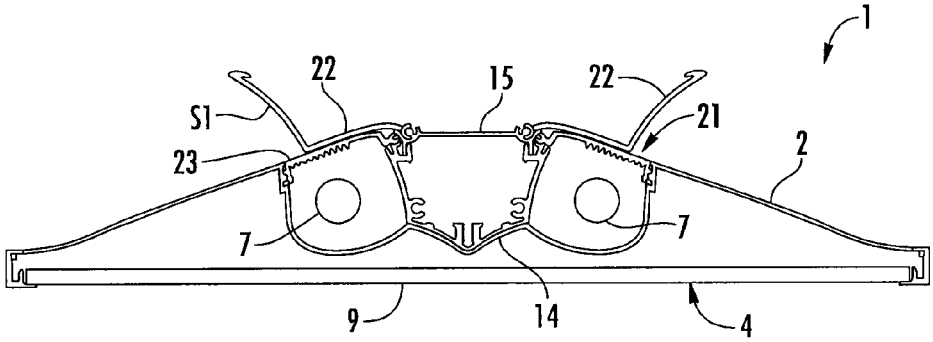
FIGS. 8 and 9 show two further exemplary embodiments of the luminaire in accordance with the invention in section.

FIG. 8 shows a variant embodiment of the luminaire 1 in accordance with the invention which in turn is intended for short pendant heights, with in this case the inner area of the light-influencing elements 22 being selected so that it has a larger surface in order to increase the proportion of direct light as a result of reflection of the light at this correspondingly formed inner area. By selecting the dimension of the overlap of the light-permeable cover 21 by the inner area of the light-influencing elements 22 it is also possible to attain a specific reduction in the proportion of light directed towards the ceiling, with the concave outer area of the light-influencing elements 22 ensuring in turn that the light reflected by it is distributed widely over the ceiling.

Figure 9:
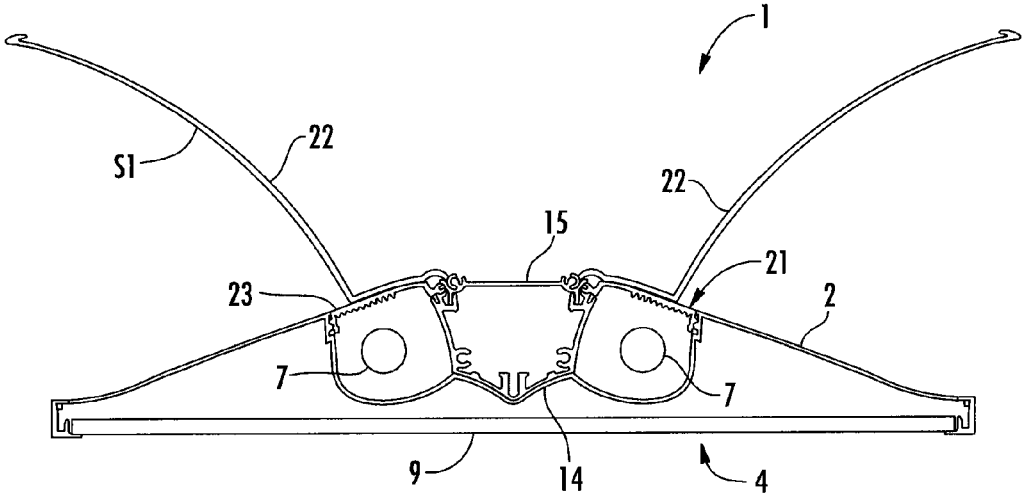

The embodiment of a luminaire 1 in accordance with the invention shown in FIG. 9 is intended in particular for large room heights, that is, correspondingly greater, pendant heights. What is characteristic of this embodiment is that the light-influencing elements 22 are constructed with a larger surface and extend into the areas above the light-guiding chambers, with there being provision, in the example shown, for those of the light-influencing elements 22 to extend into the edge area of the luminaire 1.

The inner area of the light-influencing elements 22 can be constructed by selecting the offset 24, that is, the distance between the swivel bearing and the outer area, as a partial cover with regard to the lamps in order to reduce the luminous density on the reflective outer area of the light-influencing elements 22 and maximize the proportion of direct light as a result of reflection at the inner area.

Deflection of direct light or corresponding diffusion of light is also effected at the large-surface concave outer area of the light-influencing elements 22 so that the large-surface light-distributing wings in the case of large pendant heights can also take on the function of producing indirect light performed when pendant heights from the ceiling are short.

It is to be pointed out that the light-influencing elements 22 can be configured independently of their respective structural configuration both in a reflective and a diffusing manner and in particular also in a transparent or semi-transparent manner so that it is possible to guarantee the light-generation and light-distribution that are required in the respective individual case. Within the scope of the invention, these second light-influencing elements 22 and/or the covering wall 23 (perforated sheet) and/or the reinforcing profile 14 and/or the cover 15 can be made of metal or plastics material.

The operational possibilities of interior-space luminaires or suspended luminaires are thus substantially extended by means of the present invention. Above all, a situation is reached where, regardless of the magnitude of the distance between the luminaire and the ceiling, distribution ratios between direct light and indirect light that are optimal and take account of the respective requirements can always be obtained. By means of the different embodiments of the light-distributing wings or second light-influencing elements and a more or less great elongation of the concave reflective or diffusing surfaces outside the closed luminaire structure the light distribution can be realized in an optimum manner in each case and all the requirements with regard to the respective assembly conditions can be met in spaces of different heights. All of this can be realized with very little outlay. In particular, it is even possible to decide first during assembly in situ what kind of light-distributing wings are used in order to guarantee in the best possible way the light distribution that is required locally.

The invention claimed is:

1. A luminaire, in particular a suspended luminaire, having a housing;

a front wall of the housing having a first light-emitting area with a first light-influencing element; and a rear wall of the housing having a second light-emitting area with a second light-influencing element for indirect illumination, wherein the second light-influencing element can be adjusted into at least two different positions; and wherein the second light-emitting area is formed at least in part by a light-permeable covering element which can be inserted into an emitting opening of the rear wall.

2. The luminaire according to claim 1, wherein the second light-influencing element is arranged in a detachable and preferably exchangeable manner.

3. The luminaire according to claim 2, wherein the second light-influencing element is connected to the housing by means of a clamping connection or a latching connection.

4. The luminaire according to claim 3, wherein the joint is integrated in the latching connection.

5. The luminaire according to claim 3, wherein the latching connection is formed by a latching pin preferably of rounded cross section and two latching claws that can be elastically latched onto the latching pin.

6. The luminaire according to claim 2, wherein the rear wall, at least in the area in which the second light-influencing element is arranged, is inclined towards the nearest lateral edge of the housing.

7. The luminaire according to claim 1, wherein the second light-influencing element is light-permeable or partly light-permeable at least in partial areas.

8. The luminaire according to claim 1, wherein the second light-influencing element is a reflector.

9. The luminaire according to claim 8, wherein the second light-influencing element can be adjusted between a reflector position and a covering position partly or completely covering the second light-emitting area and a freeing position freeing the second light-emitting area.

10. The luminaire according to claim 9, wherein the second light-influencing element can be swivelled between the reflector position and the freeing position and/or can be assembled, in particular latched, between the reflector position and the covering position so that it is substantially parallel to the first light-emitting area in two positions that are turned by 180°.

11. The luminaire according to claim 1, wherein the second light-influencing element is connected to the housing in such a way that it can be swivelled by means of a joint.

12. The luminaire according to claim 1, wherein the second light-emitting area and the second light-influencing element are arranged above a lamp space on the rear side of the housing.

13. The luminaire according to claim 12, wherein the second light-influencing element is arranged so that it is laterally offset with regard to the vertical central plane of the luminaire, and the latching connection or the joint is arranged in the edge area of the second light-emitting area facing the vertical central plane.

14. The luminaire according to claim 1, wherein the second light-influencing element can be assembled substantially parallel to the first light-emitting area in two positions that are turned by 180°.

15. The luminaire according to claim 1, wherein the second emitting area and the second light-influencing element along the axis of the latching connection or the joint extend over the whole associated dimension of the housing.

16. The luminaire according to claim 1, wherein a second light-emitting area and a second light-influencing element are arranged on both sides with regard to a vertical central plane of the luminaire.

17. The luminaire according to claim 1, wherein the luminaire has a width and a height and wherein a ratio of the width to the height is 4:1 to 8:1.

18. The luminaire according to claim 1, wherein the covering element is detachable, is connected to the rear wall preferably by means of a latching connection or a joint, and can be adjusted between its closed position and an open position for assembly and disassembly of the lamp respectively.

19. The luminaire according to claim 1, wherein the second light-influencing element comprises an inner area connected to the housing and an outer area extending away from the inner area, the inner area forming a concave reflector.

20. The luminaire according to claim 19, wherein the inner area and the outer area of the second light-influencing element extend at an obtuse angle in relation to each other.

21. The luminaire according to claim 19, wherein in a reflector position of the second light-influencing element the concavely formed reflector surface is located in a position in which light striking the reflector surface is reflected at least for the most part substantially parallel to the first light-emitting area.

22. The luminaire according to claim 21, wherein in a reflector position of the second light-influencing element the optical axis of the concave reflector surface extends substantially parallel to the optical axis of a reflector surface of a reinforcing profile.

23. The luminaire according to claim 1, wherein a second light-influencing element intended for high spaces or great pendant heights has a large-surface concave outer area that is used to produce direct light.

24. The luminaire according to claim 23, wherein the concave outer area of the second light-influencing element extends as far as into an edge area of the luminaire.

25. The luminaire according to claim 1, wherein the second light-influencing element comprises a heat-conducting material and forms a cooling surface for a hollow carrier profile for holding at least one light source.

26. A luminaire, in particular a suspended luminaire, having a housing;

a front side of the housing having a first light-emitting area with a first light-influencing element; and a rear side of the housing having two second light-emitting areas with a respective second light-influencing element for indirect lighting on both sides of a vertical central plane, wherein the second light-influencing elements are detachably connected to the housing by means of quick-acting connections, wherein the housing has a width and a height and wherein a ratio of the width to the height is 4:1 to 8:1, the second emitting areas are arranged on the rear side of the housing, and the quick-acting connections are arranged in an area of inner edges of the second emitting areas; and wherein each one of the two second light-influencing elements forms a reflector which reflects light emitted through the corresponding second light-emitting areas toward a side of the housing remote from the vertical central plane.

* * * * *